US008534165B2

(12) United States Patent
Wente et al.

(10) Patent No.: US 8,534,165 B2
(45) Date of Patent: Sep. 17, 2013

(54) ADJUSTABLE TOOL EXTENDER

(75) Inventors: Steve R. Wente, Kenosha, WI (US); Daniel M. Eggert, Kenosha, WI (US)

(73) Assignee: Snap-on Incorporated, Kenosha, WI (US)

( * ) Notice: Subject to any disclaimer, the term of this patent is extended or adjusted under 35 U.S.C. 154(b) by 1079 days.

(21) Appl. No.: 11/650,403

(22) Filed: Jan. 5, 2007

(65) Prior Publication Data

US 2008/0163726 A1 Jul. 10, 2008

(51) Int. Cl.
*B25B 23/00* (2006.01)

(52) U.S. Cl.
USPC ..... 81/177.2; 81/438; 248/188.5; 464/169

(58) Field of Classification Search
USPC ..... 81/177.2; 403/109.3, 109.1; 16/429
See application file for complete search history.

(56) References Cited

U.S. PATENT DOCUMENTS

| | | | | |
|---|---|---|---|---|
| 1,053,432 | A | 2/1913 | Osha et al. | |
| 1,172,797 | A | 2/1916 | Hodgkinson | |
| 1,381,900 | A | 6/1921 | Barnes | |
| 1,493,983 | A | 5/1924 | Hurley | |
| 2,382,291 | A | 8/1945 | Carlberg | |
| 2,438,633 | A | 3/1948 | Condor | |
| 2,733,885 | A * | 2/1956 | Brown et al. | 403/109.3 |
| 2,963,930 | A | 12/1960 | Clothier et al. | |
| 3,227,015 | A * | 1/1966 | Tremblay | 81/177.2 |
| 3,289,503 | A * | 12/1966 | Klatt, Jr. | 81/436 |
| 3,343,434 | A | 9/1967 | Schroeder | |
| 3,887,225 | A * | 6/1975 | McKee | 294/19.2 |
| 3,987,807 | A * | 10/1976 | Varnell | 135/66 |
| 4,070,932 | A | 1/1978 | Jeannotte | |
| 4,270,367 | A * | 6/1981 | Santore | 464/169 |
| 4,376,397 | A | 3/1983 | Newby et al. | |
| 4,470,527 | A * | 9/1984 | Middleton | 248/188.5 |
| 4,703,677 | A | 11/1987 | Rossini | |
| 4,754,670 | A * | 7/1988 | Raymond | 81/177.2 |
| 5,138,911 | A | 8/1992 | Lan | |
| 5,690,006 | A | 11/1997 | Pulliam | |
| 5,927,161 | A | 7/1999 | Clifford et al. | |
| 6,155,144 | A * | 12/2000 | Lin | 81/438 |
| 6,339,979 | B1 | 1/2002 | Chiang | |
| 6,959,629 | B2 * | 11/2005 | Hsien | 81/177.2 |
| 6,971,290 | B1 * | 12/2005 | Ybarra | 81/177.2 |
| 2005/0034573 | A1 | 2/2005 | Hsien | |

FOREIGN PATENT DOCUMENTS

| | | |
|---|---|---|
| GB | 1 348 814 | 11/1971 |
| TW | 224538 B | 11/2003 |

* cited by examiner

*Primary Examiner* — Monica Carter
*Assistant Examiner* — Melanie Alexander
(74) *Attorney, Agent, or Firm* — Seyfarth Shaw LLP

(57) ABSTRACT

An adjustable tool extender includes a sleeve defining a receptacle and an extension member having a first end and a second end, wherein the second end defines a cavity and is slidable within the receptacle of the sleeve. The extender also includes a bias member seated in the receptacle and an end disposed in the cavity for biasing the extension member outwardly from the sleeve to a fully extended position.

10 Claims, 5 Drawing Sheets

ADJUSTABLE TOOL EXTENDER

BACKGROUND

A variety of wrenches are commonly used to apply torque to a work piece, such as a threaded fastener. The work piece may have any number of different sizes and shapes. Accordingly, many wrenching tools include a driver which is mateable with any of a number of different adapters, such as sockets, to engage and rotate the different-sized work pieces.

Many times these wrenching devices are used to apply torque to fasteners that are in difficult-to-reach spaces or spaces which have limited room in which to adjust and/or turn the fasteners. In such situations, extensions are typically attached between the wrenching devices and sockets to enable the wrenching devices to reach fasteners in difficult locations. These extensions are typically solid, cylindrical extensions which connect to the head of the wrenching device and to the socket. The extensions come in many different sizes to accommodate different extension lengths and different-sized fasteners. These type of extensions are limited in that, when a fastener is tightened or loosened, the distance between the wrenching device and fastener changes as the fastener moves closer to the wrenching device as it is being loosened or away from the wrenching device as it is being tightened. In some situations, the user has to change to a different size extension to accommodate for the change in distance between the fastener and the wrenching device during use.

Other extensions include a tubular outer member and a solid inner member which slides within the outer member to adjust the extension to different incremental lengths without having to completely change the extension. One such extension is described in U.S. Pat. No. 4,376,397 and is directed to an adjustable extension including a driver-engaging member moveable within a work-engaging member. The extension includes a plurality of detents that are spaced along the length of the driver-engaging member and are engaged by a latch member to hold the work-engaging member at one of various different incremental positions. As a result, only one extension is needed. This type of extension, however, requires a user to continuously adjust the incremental position of the extension based on the distance between a wrenching device and a fastener, which takes significant time and effort.

Another type of extension includes an outer member and an inner member that is slidable within the outer member. A spring biases the inner member outwardly away from the outer member to adjust to the changing distances between the wrenching device and the fastener as the fastener is being tightened or loosened. These extensions have limited extension or compression lengths because space is needed for the spring seated inside the extension. Also, the diameters of the outer member and the inside member are very similar in size, which may lead to the extension binding or locking up during use. This type of extension therefore is limited in its extendability and can lead to increased costs and delays due to the extension binding up or breaking during use.

Accordingly, there is a need for an adjustable extension for a wrenching device which automatically adjusts during use and which helps to prevent the extension from binding during use.

SUMMARY

This application is directed to an adjustable extender and, more specifically, to an adjustable tool extender for a wrenching device, such as a ratchet, that enables a user to engage a connector in a hard to reach position and which automatically adjusts the length of the extender during the tightening or loosening of the connecr.

One embodiment provides an adjustable tool extender including a sleeve defining a receptacle and an extension member having a first end and a second end, where the second end defines a cavity and is slidable within the receptacle of the sleeve between fully extended and fully retracted positions. The adjustable tool extender also includes a bias member seated in the receptacle and an end disposed in the cavity, wherein the bias member biases the extension member outwardly from the sleeve to the fully extended position.

In an embodiment, the extension member has a first diameter, where at least a portion of the extension member intermediate to the first and second ends has a second diameter which is less than the first diameter.

In an embodiment, the bias member is a coil spring.

In an embodiment, the bias member is a tapered spring and the cavity is tapered to receive the tapered spring.

In an embodiment, the second end of the extension member has a polygonal shape.

In an embodiment, the receptacle has a polygonal interior surface.

In an embodiment, the second end of the extension member has a polygonal-shaped end that slidably engages the interior surface of the receptacle.

In an embodiment, the sleeve has a crimped end to capture the second end of the extension member in the receptacle.

In an embodiment, the sleeve has a side opening, and further comprises a pin that is at least partially inserted into the opening.

In an embodiment, further includes a seat member disposed in the receptacle and against which the bias member is seated.

In an embodiment, the extension member has at least one recess therein, and further includes a pawl connected to the sleeve and engageable with the at least one recess.

In an embodiment, the adjustable tool extender includes an actuator for releasing the pawl from engagement with the extension member.

Another embodiment provides an adjustable tool extender including a sleeve defining a receptacle and an extension member having a first end and a second end, where the second end is slidable within the receptacle of the sleeve. The extension member has an intermediate portion between the first and second ends which has a cross-sectional area that is substantially less than that of either of the first and second ends.

In an embodiment, the second end of the extension member has a polygonal shape.

In an embodiment, the receptacle has a polygonal interior surface.

In an embodiment, the second end of the extension member has a polygonal shape that slidably engages the polygonal interior surface of the receptacle.

In an embodiment, the sleeve has a crimped end to capture the second end of the extension member in the receptacle.

In an embodiment, the sleeve has a side opening, and further includes a pin that is at least partially inserted into the opening.

In an embodiment, the adjustable tool extender includes a bias member disposed between the sleeve and the extension member that biases the extension member to the fully extended position.

In an embodiment, the extension member has at least one recess therein, and further includes a pawl connected to the sleeve and engageable with the at least one recess.

In an embodiment, the adjustable tool extender includes an actuator coupled to the pawl for releasing the pawl from engagement with the extension member.

Accordingly, an advantage is to provide an adjustable extender for a tool that enables a user to easily and quickly adjust the length of the extender.

Another advantage is to provide an adjustable extender which automatically adjusts its length as it is being used.

A further advantage is to provide an adjustable extender for a tool which reduces the torque applied to the extender and the tool during use.

Other objects, features and advantages will be apparent from the following detailed disclosure, taken in conjunction with the accompanying sheets of drawings, wherein like numerals refer to like parts, elements, components, steps and processes.

DETAILED DESCRIPTION

Figure 1:
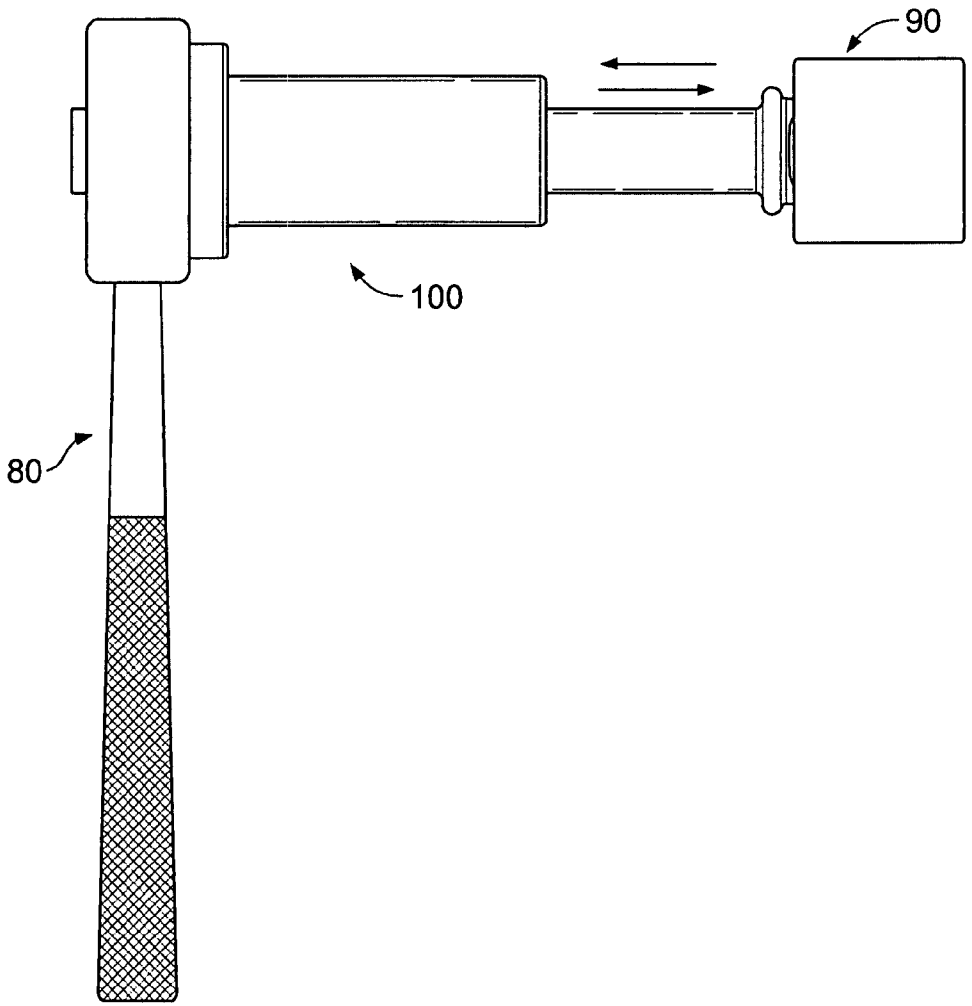
FIG. 1 is a perspective view of an embodiment of the adjustable extender connected to a ratchet at one end and to a socket at an opposite end.
Figure 2:
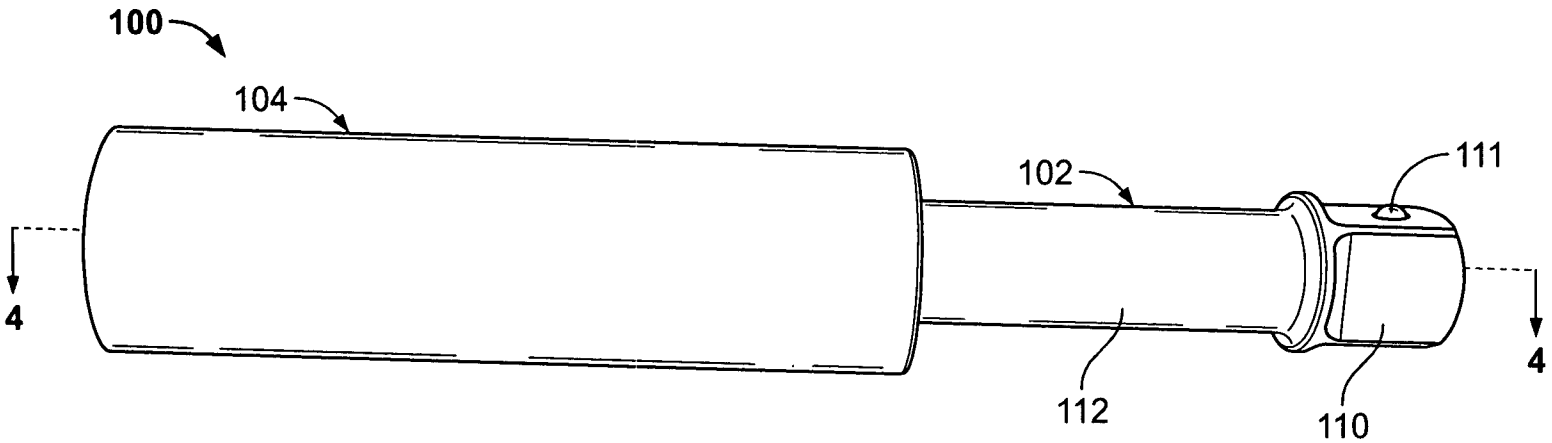
FIG. 2 is a an enlarged perspective view of the adjustable extender shown in FIG. 1.
Figure 3:
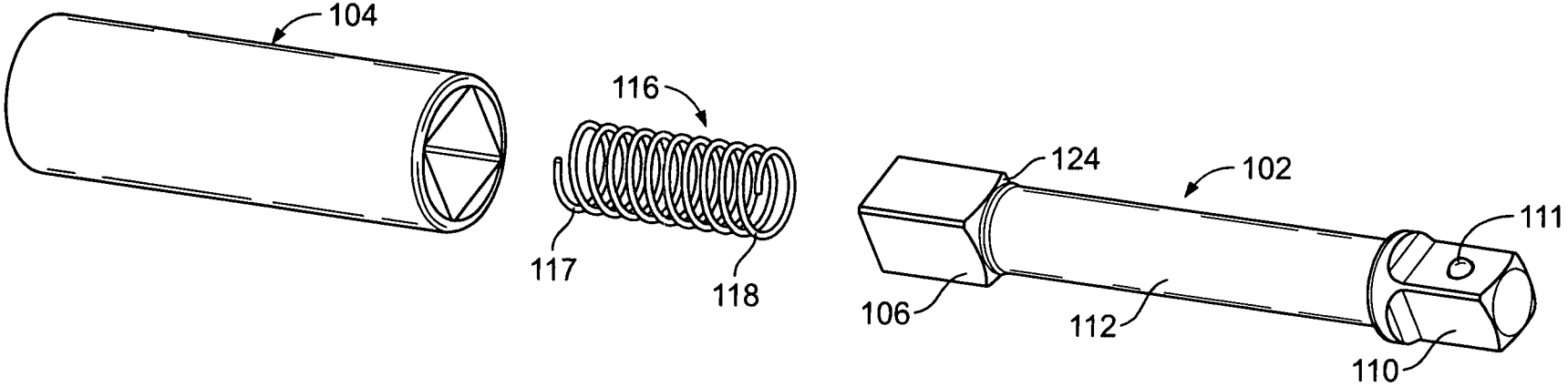
FIG. 3 is an enlarged perspective view of the adjustable extender shown in FIG. 1.

Referring now to FIGS. 1, 2, 3, 4, and 5, in one embodiment, an adjustable-length tool extender or adjustable extension 100 for a wrenching device, such as a ratchet wrench, is provided where the adjustable tool extender is connected at one end to a wrenching device such as a ratchet wrench 80, and at an opposing end to a work piece or work piece-engaging device, such as a socket 90. The adjustable extension 100 automatically adjusts the distance between the ratchet wrench 80 and the socket 90 as a fastener engaged by the socket 90 is being loosened or tightened. This saves significant time and effort and also minimizes the number of parts needed to perform these functions.

The adjustable tool extender 100 includes an extension member 102 that is slidably connected to or slidable within a tubular member or sleeve 104. An extension member 102 is generally a solid part which is formed to have a polygonal-shaped inner end 106 and an opposing connecting end 110. The polygonal-shaped end 106 of an extension member 102 corresponds to the cross-sectional shape of the inside surface 108 of the sleeve 104. This facilitates the movement of an extension member 102 within the sleeve 104 and also minimizes the relative rotational movement between the extension member and the sleeve. The polygonal shape may be square or could be other shapes, such as hexagonal. The opposing end 110 of an extension member 102 may have a generally square-shaped surface to engage a similarly shaped receptacle of a socket or other connector.

In an embodiment, a detent ball 111 is positioned in the end 110 to engage a corresponding recess in the socket or other connector. A bias member, such as a spring 113, biases the ball 111 outwardly to help maintain the connection between the socket and the adjustable extension 100, in a known manner. It should be appreciated that the ends 106 and 110 may be any suitable size or shape. An extension member 102 also includes a reduced thickness intermediate section 112 which may be cylindrical in shape with a thickness smaller than the thickness of the ends 106 and 110. This helps to absorb twisting forces applied to the tool extender 100 during use. This also minimizes the chance that extension member 102 will frictionally engage the inside surface of the sleeve 104 and thereby bind up or lock up the extender within the sleeve. This could cause the adjustable extension 100 to break or be non-functional and increase the cost and time for using the tool.

Figure 4:
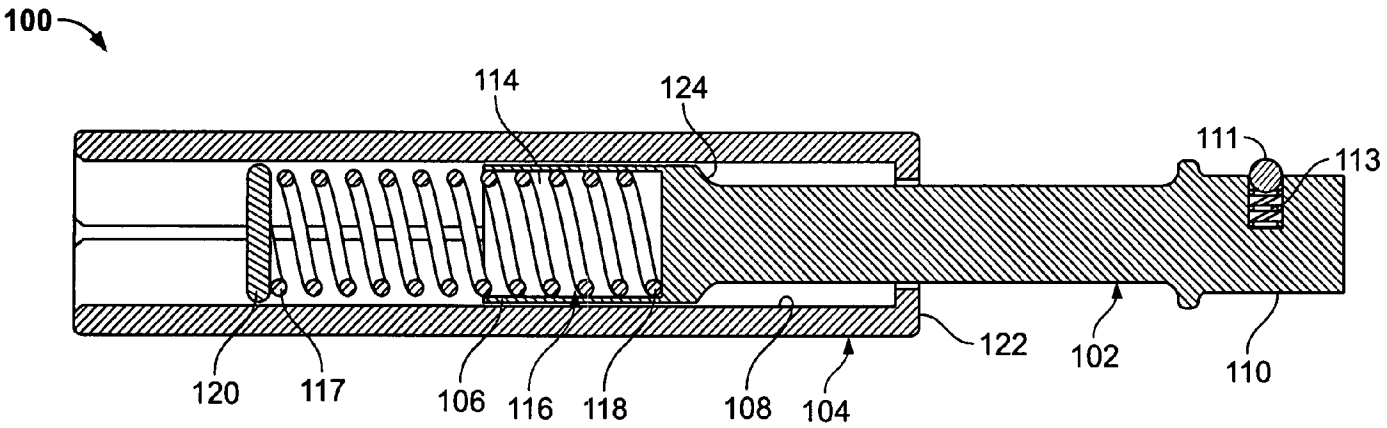
FIG. 4 is a longitudinal cross section view of the adjustable extender of FIG. 1 taken substantially along line 4-4 in FIG. 2, wherein the adjustable extender is in a fully extended position.

A spring, such as a helical coil spring 116, is positioned within the sleeve 104 to bias the end 106 and thereby an extension member 102 outwardly away from the sleeve 104 to a fully extended position shown in FIG. 4. Specifically, one end 117 of the coil spring 116 is seated against a seat member or ring 120 inside the sleeve 104. The ring 120 may be a split ring seated in a groove defined by the interior surface 108 of the sleeve. The opposing end 118 of the coil spring 116 is received by a cavity 114 defined by the inner end 106 of an extension member 102. The cavity 114 is sized and shaped to correspond to the size and shape of the end 118 of the coil spring 116. By having the cavity 114 defined in an extension member 102, substantial space within the sleeve is saved and also enables the spring to have more room to expand and/or contract. This enables the extension member 102, and thereby the tool extender, to be able to extend to greater distances away from the tool or retract further within the sleeve.

Figure 5:
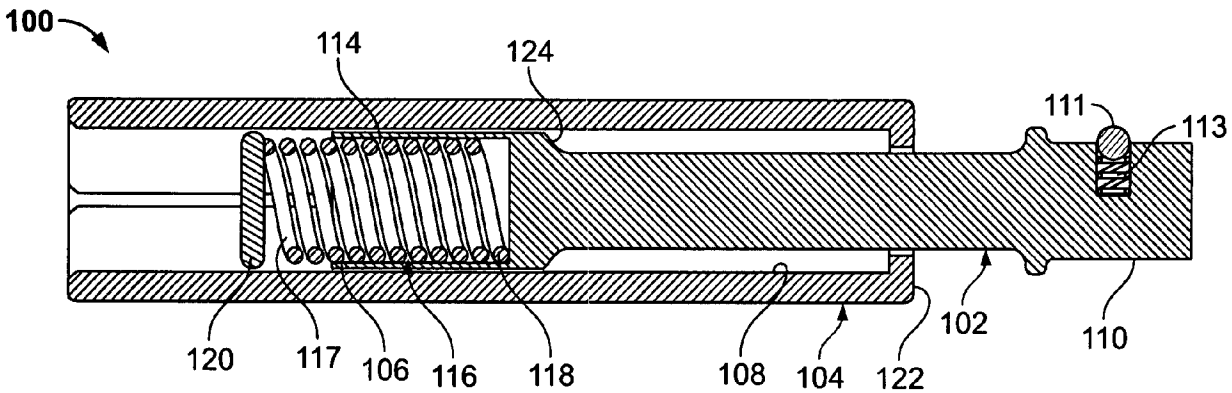
FIG. 5 is a view similar to FIG. 4 wherein the adjustable extender is in a retracted position.

As shown in FIGS. 4 and 5, the coil spring 116 has a generally uniform diameter and shape. It should be appreciated that the coil spring 116 may be any suitable size and shape as will be discussed in more detail below. As shown in FIG. 4, the coil spring 116 expands to push against the extension member 102 to move it outwardly from the sleeve 104. The end 106 of the extension member 102 defines a shoulder 124 which engages a crimped end 122 of the sleeve 104 to prevent extension member 102 from moving completely out of the sleeve 104. Specifically, the shoulder 124 contacts the crimped end 122 of the sleeve to stop an extension member 102 from moving further outwardly from the sleeve 104. It should be appreciated that the end of the sleeve does not necessarily have to be crimped. In another embodiment, a roll pin 119 (shown in FIG. 6) or other suitable pin is inserted at least partially into or through a portion of the sleeve to engage the shoulder 124 and thereby stop the outward movement of the extension member. It should also be appreciated that any other suitable method or methods may be used to prevent extension member 102 from completely being moved out of or removed from the sleeve 104.

As shown in FIG. 5, an extension member 102 is being compressed or moved inwardly within the sleeve 104. This causes the spring 116 to compress between the extension member 102 and the sleeve 104 and more specifically, between the end 106 of the extension member 102 and the ring 120 of the sleeve. The compressed spring shown in FIG. 5 will naturally expand back to its expanded position shown in FIG. 4.

In the above embodiments, the adjustable tool extender 100 is a particular size and shape. It should be appreciated that the adjustable tool extender 100 may be any suitable size and shape to accommodate any devices, tools, work pieces and different work locations.

Figure 6:
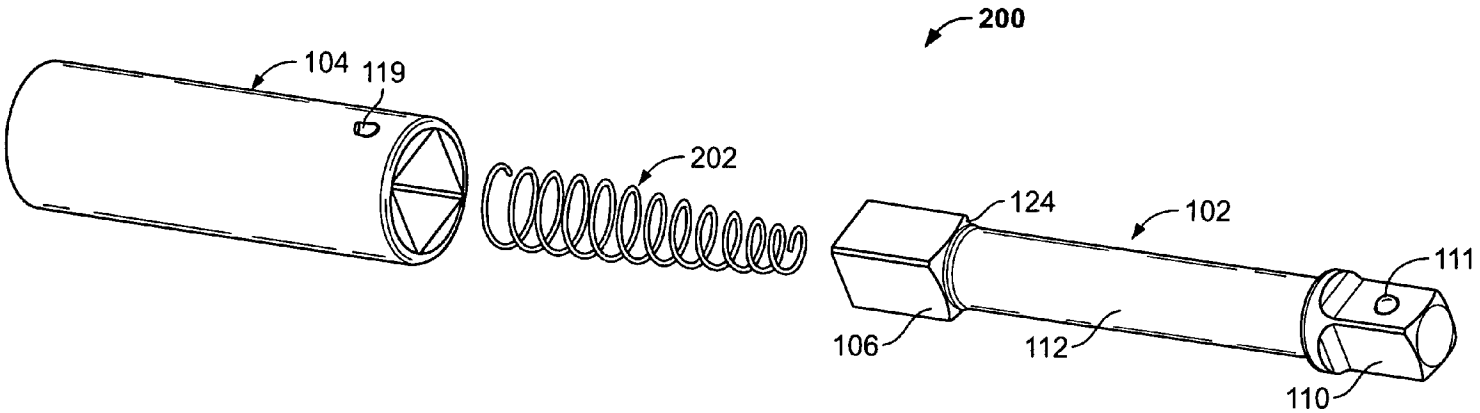
FIG. 6 is a perspective view of another embodiment of the adjustable extender.

Referring now to FIG. 6, another embodiment of the adjustable tool extender is illustrated. The adjustable tool extender 200 includes an extension member 102 and the sleeve 104 described above, as well as a bias member or spring 202. In this embodiment, the spring 202 has a tapered or angled shape. Similarly, a cavity not shown) defined by the end of the extender also has a corresponding tapered shape. A tapered spring functions similar to the spring 116 described above and it biases an extension member 102 away from the sleeve 104 to allow the adjustable tool extender 100 to automatically adjust to the change and distances between a wrenching device and a fastener. The tapered spring 202 also requires less material to be removed from the end 106 of an extension member 102, which improves the overall structural integrity of an extension member 102 due to the increase in material at this end. This extends the life of the extension member 102 and thereby, the life of the adjustable tool extender 100.

Figure 7:
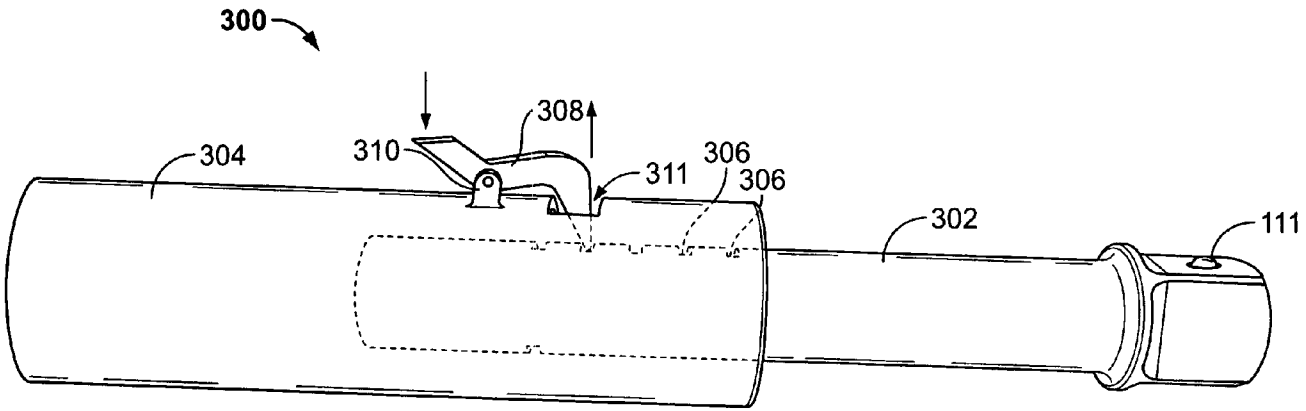
FIG. 7 is a perspective view of a further embodiment of the adjustable extender.

Referring now to FIG. 7, a further embodiment of the adjustable tool extender is illustrated generally by reference number 300. The adjustable tool extender 300 includes an extension member 302 and a sleeve 304. As described above, the extender 302 slides within the sleeve 304. In this embodiment, the extension member 302 includes a plurality of notches or recesses 306. A pawl or lever arm 308 is pivotably connected to arms 310 connected to the outside surface of the sleeve. The pivot arm 308 may be biased to pivot inwardly through an opening 311 in the sleeve to engage one of the recesses, grooves or notches 306 on the extension member. The pivot arm 308 thereby holds the extension member in place in a particular incremental position. In an embodiment, the lever arm 308 includes at least one actuator for releasing the lever arm from the recess. If a different incremental position is desired, a user presses against or pushes on the end of the pivot arm 308 to pivot it upwardly out of engagement with the recess or notch on the extension member 302. The extension member 302 then can be moved inwardly or outwardly to adjust the length of the adjustable tool extender. The user releases the pivot arm 308 to enable it to engage a new recess or notch 306 that is positioned beneath the end of the pivot arm. Because the pivot arm 308 is biased into engagement with one of the recesses 306 on the extension member 302, the adjustable tool extender 300 can be easily adjusted to different lengths as needed.

The above embodiments of the adjustable extension are generally made of a durable material such as a steel, stainless steel, or other suitable material or a combination of materials. It should be appreciated that the adjustable extension described above may be any suitable size or shape to accommodate different work pieces and working locations.

The embodiments set forth in the foregoing description and accompanying drawings are offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. An adjustable tool extender comprising:

a wrenching device;

a sleeve defining a receptacle having an interior surface, the sleeve having an attachment end for cooperation with the wrenching device;

an extension member having a first end and a second end integral with an intermediate portion extending between the first and second ends, the extension member being a single substantially solid component, said second end defining a cavity and the extension member being slidable within said receptacle of said sleeve between fully extended and fully retracted positions, said intermediate portion being positioned so as to not engage the interior surface; and a bias member, having a proximate and distal end, the distal end seated in said receptacle and having the proximate end disposed in said cavity, wherein said cavity is configured to receive a substantial portion of said bias member, wherein said bias member biases said extension member outwardly from said sleeve to the fully extended position and selectively expands and contracts responsive to a compressive force applied by a user from the wrenching device to the attachment end.

2. The adjustable tool extender of claim 1, wherein said extension member has a first diameter, and wherein at least a portion of said extension member intermediate to said first and second ends has a second diameter which is less than said first diameter.

3. The adjustable tool extender of claim 1, wherein said bias member is a coil spring.

4. The adjustable tool extender of claim 1, wherein said bias member is a tapered spring, and wherein said cavity is tapered to receive said tapered spring.

5. The adjustable tool extender of claim 1, wherein said second end of said extension member has a polygonal shape.

6. The adjustable tool extender of claim 1, wherein said receptacle has a polygonal interior surface.

7. The adjustable tool extender of claim 6, wherein said second end of said extension member has a polygonal-shaped end that slidably engages said interior surface of said receptacle.

8. The adjustable tool extender of claim 1, wherein said sleeve has a crimped end to capture said second end of said extension member in said receptacle.

9. The adjustable tool extender of claim 1, wherein said sleeve has a side opening, and further comprises a pin that is at least partially inserted into said opening.

10. The adjustable tool extender of claim 1, and further comprising a seat member disposed in said receptacle and against which said bias member is seated.

* * * * *